United States Patent [19]

Fukae et al.

[11] Patent Number: 4,786,943

[45] Date of Patent: Nov. 22, 1988

[54] DEVICE FOR REMOVING RESIDUAL DEVELOPER PARTICLES FROM A PHOTOCONDUCTIVE MEMBER

[75] Inventors: Kensuke Fukae, Monsey, N.Y.; Toshio Muramatsu, Nagano, Japan

[73] Assignee: Kentek Information Systems, Inc., Allendale, N.J.

[21] Appl. No.: 33,457

[22] Filed: Apr. 1, 1987

[51] Int. Cl.[4] ..... G03G 15/08

[52] U.S. Cl. ..... 355/15; 355/3 R; 118/652

[58] Field of Search ..... 355/15, 14 R, 3 R, 300, 355/140; 118/652; 15/1.5 R, 256.51, 256.52

[56] References Cited

U.S. PATENT DOCUMENTS

| | | | |
|---|---|---|---|
| 3,580,673 | 5/1971 | Yang | 355/15 |
| 3,692,402 | 9/1972 | Solarek | 355/3 |
| 3,781,107 | 12/1973 | Ruhland | 355/15 |
| 3,884,572 | 5/1975 | Bacon et al. | 15/1.5 R X |
| 4,006,987 | 2/1977 | Tomono et al. | 355/15 |
| 4,071,296 | 1/1978 | Ermel et al. | 355/15 |
| 4,252,433 | 2/1981 | Sullivan | 355/15 |
| 4,361,922 | 12/1982 | Karal | 355/15 X |
| 4,451,139 | 5/1984 | Yanagawa et al. | 355/15 |
| 4,482,244 | 11/1984 | Yamazaki et al. | 355/15 |
| 4,506,975 | 3/1985 | Shukuri et al. | 355/15 |
| 4,515,467 | 5/1985 | Suzuki | 355/15 |
| 4,530,597 | 7/1985 | Itaya et al. | 355/15 |
| 4,533,236 | 8/1985 | Garsin | 355/15 |
| 4,568,175 | 2/1986 | Inowa et al. | 355/15 |
| 4,571,070 | 2/1986 | Tomita | 355/15 |
| 4,660,962 | 4/1987 | Maekawa et al. | 355/15 |

*Primary Examiner*—A. C. Prescott
*Assistant Examiner*—Jane Lau
*Attorney, Agent, or Firm*—Marmorek, Guttman & Rubenstein

[57] ABSTRACT

A device for removing residual particles from a photoconductive member comprises a fur brush in contact with the photoconductive member, a metal roller in contact with the fur brush, and a scraper blade in contact with the metal roller. The fur brush is maintained at a first biasing voltage, e.g., +50V, while the metal roller is maintained at a second biasing voltage which is of the same polarity but greater in magnitude than the first biasing voltage, e.g., +150V. The fur brush attracts residual particles from the photoconductive member while the metal roller attracts residual particles from the fur brush. The scraper blade scrapes the residual particles from the metal roller, the particles falling into a conveying auger for recycling.

16 Claims, 2 Drawing Sheets

DEVICE FOR REMOVING RESIDUAL DEVELOPER PARTICLES FROM A PHOTOCONDUCTIVE MEMBER

BACKGROUND OF THE INVENTION

The present invention relates to a cleaning device for removing residual developer particles from a photoconductive element of an electrographic copier or printer. More particularly, the present invention relates to a cleaning device comprising the combination of a fur brush, a metal roller and a scraper blade for removing residual developer particles from a photoconductive element of an electrographic printer or copier.

In the process of electrophotographic or xerographic printing, a photoconductive member is employed to record an image. The photoconductive member, which typically is in the form of a belt or a drum, is charged to a substantially uniform potential to sensitize its surface. In the case of a copying machine, the charged portion of the photoconductive surface is exposed to a reflected light image of an original document to be reproduced. The light image is recorded as an electrostatic latent image on the photoconductive member corresponding to the informational areas contained on the original document.

In the case of a printer connected to a computer, a similar process is used to record information on the photoconductive member. The charged portion of the photoconductive surface is exposed to a light image, the shape of which is controlled by input signals from the computer. For example, a laser or an LED array receiving input signals from the computer functions as an optical print head and illuminates the photoconductive member with a light image of a particular shape. Here too, an electrostatic latent image corresponding to desired informational areas is recorded on the photoconductive member.

After recording the electrostatic latent image on the photoconductive member, the latent image is developed by bringing a developer material or toner into contact with it. The developer material is attracted to the electrostatic latent image and forms a powder image on the photoconductive member corresponding to the electrostatic latent image. The powder image is subsequently transferred to a sheet of recording medium, such as a sheet of paper. Thereafter, the powder image is permanently affixed to the sheet in image configuration by a variety of methods, such as by fusing.

The above-mentioned operations may be carried out by arranging a number of stations in sequence about the photoconductive member. Thus, the photoconductive member is usually surrounded in sequence by a charging station, an maging station, a developing station, and a transfer station. A discharging station and a cleaning station are also arranged about the photoconductive member to ready it for use again.

As used herein, the term "electrographic printing apparatus" and the like are intended to include both copying and printing machines. Such machines include a developer unit operative to deliver toner to the photoconductive member. Typically the toner is stored in a hopper where it is mixed with a suitable carrier. The carrier often comprises iron or other metal particles. When mixed with the carrier, the toner acquires a suitable electrostatic charge so that it may easily be transferred to the photoconductive element to develop th latent electrostatic image formed thereon. Usually, a cleaning device is also installed in the electrographic printing apparatus in order to remove toner and other developer particles which remain on the surface of the drum or the belt after the transfer of the developed image to the sheet of recording medium. In some cases, the cleaning device is integrated into the developer unit which alternately functions in either a developing or a cleaning mode.

Heretofore, a variety of devices and methods have been used to clean residual developer particles from the photoconductive belt or drum. Thus, the cleaning device often comprises a brush which is used to remove the developer particles. The brush has a length substantially equal to the width of the photoconductive element in order that the entire photoconductive element be swept clean. The cleaning brush is formed using a suitable material to attract the toner particles, and it is positioned to face the photoconductive element so that it may contact its surface in order to remove the residual developer material.

However, cleaning brushes are not entirely satisfactory for their intended purpose. Cleaning brushes alone, particularly after extensive use, are not effective in removing all of the residual particles from the photoconductive member. The removal of residual particles which have accumulated on the cleaning brush is always a problem. Furthermore, even when means are provided generally for removing such residual particles, after extensive use, it becomes difficult to remove the developer particles from the cleaning brush in the center regions of the brush. This tends to bring about irregularity in the cleaning operation because of uneven contact with the photosensitive member. In order to overcome this problem, complicated devices, such as that described in U.S. Pat. No. 4,571,070 (Tomita), have been proposed.

In an alternative method of cleaning the photoconductive element, a scraper blade is applied to the photoconductive element. The scraper blade, typically made from a hard rubber material, is held against the photoconductive element and scrapes it free of residual toner particles. For example, U.S. Pat. No. 4,568,175 (Inowa et al) discloses a blade cleaning device for removing toner particles remaining on the surface of a photoreceptor.

Such blade-cleaning devices are not entirely satisfactory either. First, there is the problem of maintaining the blade in even contact with the surface of the photoconductive element. Particularly as time goes by, irregularities across the width of the blade occur so that the blade is no longer maintained in even contact with the photoconductive element. Second, in many cases the blade used to clean the photoconductive element may scratch the photoconductor surface. This is particularly true when the developer material is a two component developer which includes ferrite particles. The combination of the blade and the hard ferrite particles has a tendency to scratch the sensitive surface of the photoconductive element. Third, the cleaning blade must be maintained at a fixed angle to the photoconductive element. This necessitates the use of relatively complicated structures. For example, see the structure disclosed in U.S. Pat. No. 4,568,175 (Inowa et al).

Accordingly, it is an object of the present invention to provide a cleaning device for removal of residual developer particles from a photoconductive element which cleaning device does not suffer from the deficiencies of prior art cleaning brushes and cleaning blades.

In particular, it is an object of the present invention to provide a cleaning device for removal of developer material from a photoconductive member which does not require high tolerances of prior art cleaning brushes and cleaning blades.

It is a further object of the present invention to provide such a cleaning device which permits recycling of the developer particles remaining on the photoconductive element.

It is still a further object of the present invention to provide such a cleaning device which is simple, cheap to construct, and can be attached to a disposable photoconductive belt assembly.

SUMMARY OF THE INVENTION

In accordance with the present invention, a cleaning device for removing residual developer particles from a photoconductive member is provided. The cleaning device includes a cleaning brush which is maintained in contact with the photoconductive member. A first biasing voltage is applied to the cleaning brush in order to attract the residual particles from the photoconductive member to the cleaning brush. A transferring member is maintained in contact with the cleaning brush. A second biasing voltage is applied to the transferring member. This second biasing voltage is of the same polarity but greater in magnitude than the first biasing voltage applied to the cleaning brush. Thereby, the residual developer particles which are on the cleaning brush are attracted to the transferring member. A removal member, such as a scraper blade, is then applied to the transferring member thereby removing the developer particles which have been attracted to the transferring member.

In a preferred embodiment, the present invention comprises a fur brush which is maintained in contact with the photoconductive member. A metal roller serves as the transferring member to remove developer particles from the fur brush. A scraper blade removes the developer particles from the metal roller. A biasing voltage of about +50 V is applied to the fur brush in order to attract residual particles from the photoconductive member, and a second biasing voltage of about +150 V is applied to the metal roller in order to attract developer particles from the fur brush to the metal roller.

In an even further preferred embodiment of the present invention, the cleaning device further comprises a worm-screw or auger associated with the scraper blade. The auger receives developer particles removed by the scraper blade from the metal roller and transports them to a station where they can be recycled, e.g., back to the developer unit.

DETAILED DESCRIPTION OF PREFERRED EMBODIMENT

Figure 1:
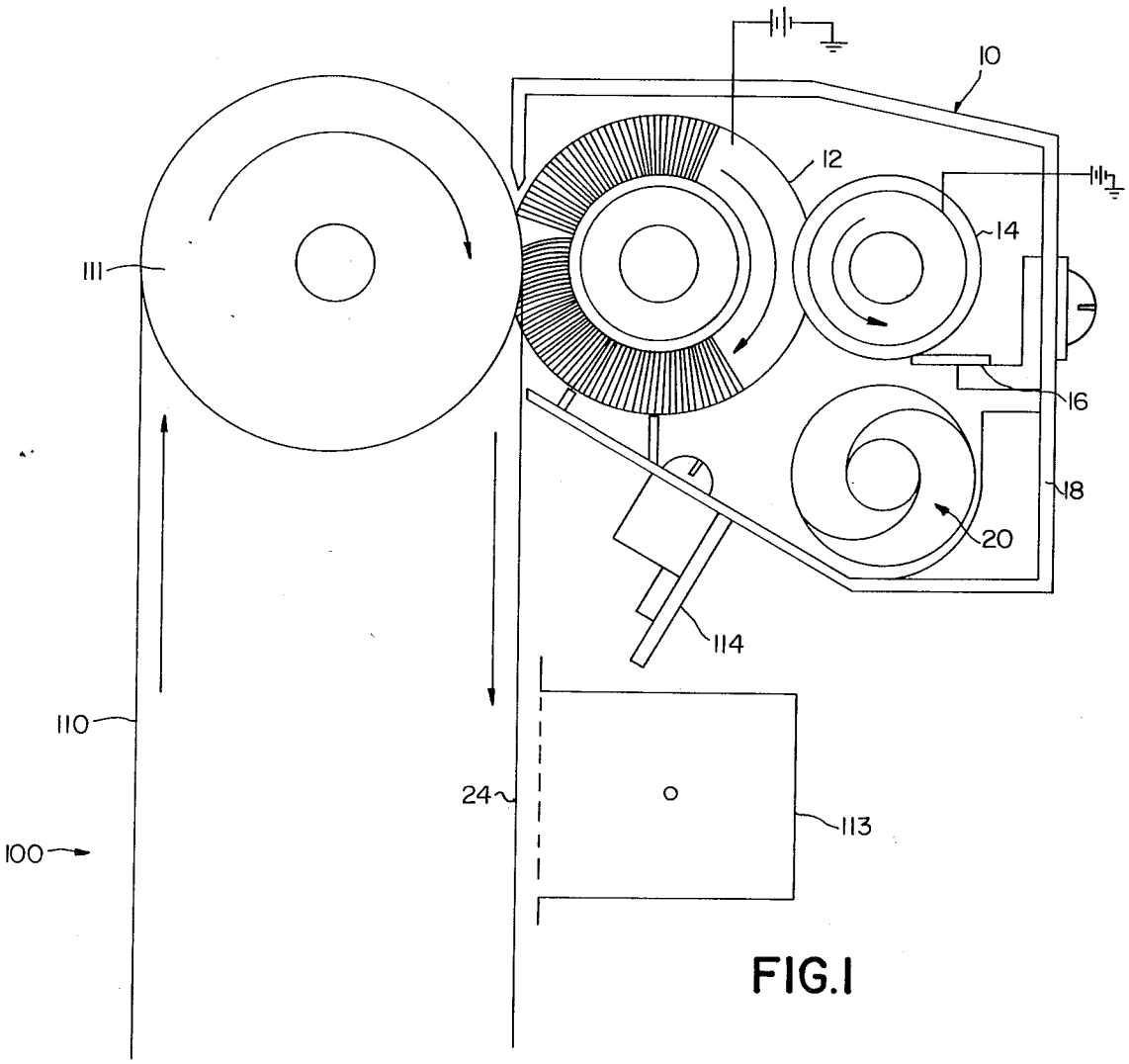
FIG 1 illustrates a preferred embodiment of the cleaning device of the present invention.

Referring to FIG. 1, a cleaning device in accordance with the principles of the present invention, is illustrated. A cleaning device, generally shown as 10, is arranged as a unit or a station opposite the photoconductive element 100. Cleaning device 10 is arranged after the transfer station in the electrographic printing apparatus. In this case, the photoconductive element 100 comprises a photoconductive belt 110 which rotates about the roller 111 in the direction shown by the arrows.

Desirably, the photoconductive element 100 is a disposable photoconductive belt assembly in the form of a cassette described in allowed application Ser. No. 718,947, filed Apr. 2, 1985. This cassette is adapted to be vertically mounted in an electrographic printer/copier of the kind described in allowed application Ser. No. 700,813, filed Feb. 11, 1985. Both of these applications have been assigned to the assignee of the present application and are incorporated herein by reference. In accordance with the present invention, the cleaning device 10 is mounted directly onto the disposable cassette and is discarded along with the cassette when the usable life of the photoconductive belt has been exceeded.

The cleaning device 10 comprises a cleaning brush 12 of a length which is substantially equal to the width of the photoconductive belt 110. Such cleaning brushes are well known to those skilled in the art and are often made from a fur material such as a suitable acrylic material. A metal roller 14 serves as a transferring member in contact with fur brush 12. A scraper blade 16 is positioned to make contact with metal roller 14.

A worm-screw or auger 20 is disposed within housing 18 of cleaning device 10. The purpose of auger 20 is to transport developer particles which have been scraped from the metal roller so that they may be recycled or discarded.

The cleaning device is enclosed within a housing 18. Cleaning device 10 is thereby a separate unit and can be replaced apart from the remainder of the cassette in appropriate cases. However, in normal use, it is expected that cleaning device 10 will be replaced along with the cassette after suitable periods of use.

In operation, a first biasing voltage of about +50 V is applied to fur brush 12. A second biasing voltage of about 150 V is applied to metal roller 14. As photoconductive 110 rotates, residual developer particles remaining on the belt after transfer of the powder image to the paper are swept clean by fur brush 12. The particles are attracted to the fur brush due to the first biasing voltage applied to the fur brush. The residual particles on fur brush 12 are then attracted to metal roller 14 due to the second biasing voltage which is higher in magnitude than that applied to the fur brush. Thereafter, as metal roller 14 rotates along with fur brush 12 and photoconductive belt 2, the residual particles are scraped free from metal roller 14 by scraper blade 16 and fall into the windings of auger 20. It should be observed that scraper blade 16 does not make contact with the sensitive photoconductive element. Auger 20 rotates and thereby transports the developer particles out from cleaning device 10 where they may be either recycled or discarded, preferably recycled.

Figure 2:
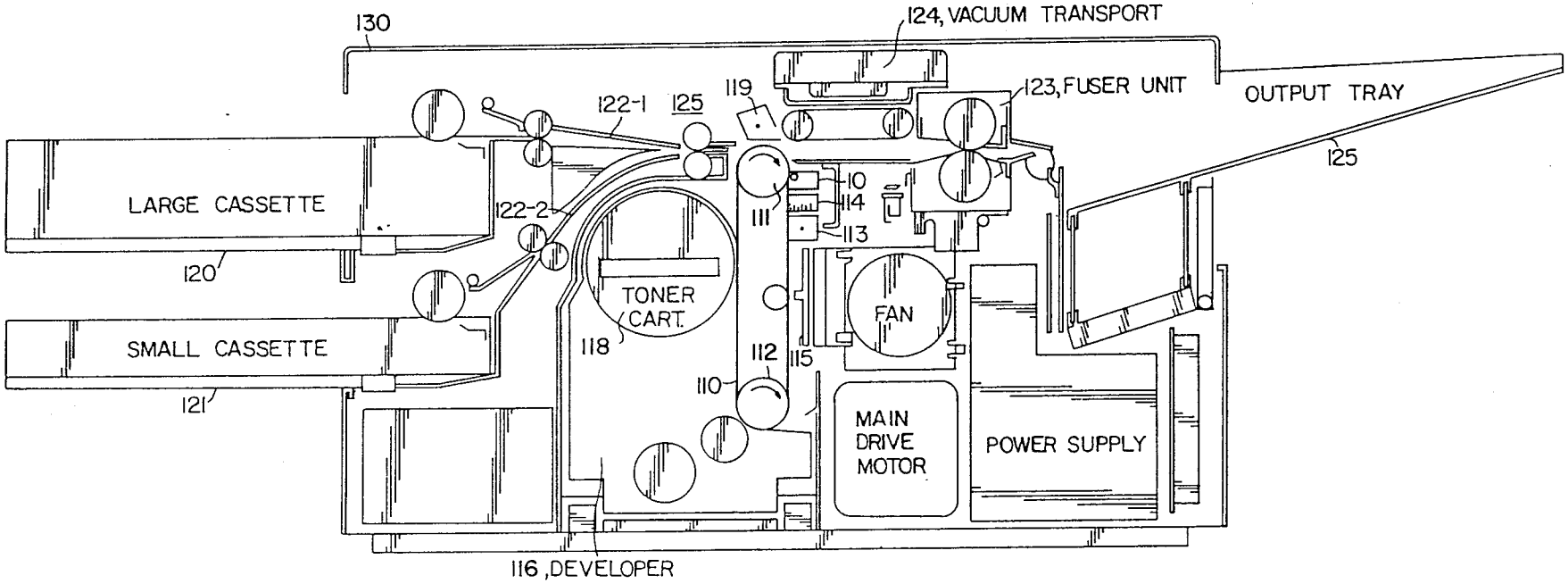
FIG. 2 is a schematic diagram of an electrographic printer employing the cleaning device of the present invention.

FIG. 2 is a block diagram showing the basic components of an electrographic printer which incorporates the novel cleaning device of the present invention. This electrographic printer is similar in construction to that described in allowed application Ser. No. 700,813, filed Feb. 11, 1985, which employs the vertically mounted disposable cassette described in application Ser. No. 718,947, filed Apr. 2, 1985.

As illustrated, this printer includes photoconductive belt 110 which is rotated clockwise by means of rollers 111 and 112. Located along the right side of the belt, as viewed in FIG. 2, are the cleaning unit 10, erase lamps 114, main charger 113, and an optical print head 115. On the left side of the unit is the developer 116. This unit contains a toner cartridge 118 for convenient handling. Located at the top of the belt path is a transfer unit 119, which unit creates an electric field to attract toner from photoconductive belt 110 onto the underside of sheets of paper passing through the image transfer region 125.

The copy material, e.g., paper, is derived from either of two convenient paper handling cassettes 120 and 121. The paper is directed along either of two paper paths 122-1 or 122-2 to the image transfer region 125 located between the upper roller 111 and the transfer unit 119. From the image transfer region 125, the paper is then transported to a fuser unit 123 by means of a vacuum transport unit 124 and finally deposited in an output tray 125.

The operation of the printer involves single rotation of the belt per copy produced. During this rotation, the belt is uniformly charged as it passes main charger 113. A latent image is generated by means of the optical print head 115, which can be either a laser or an LED array. The optical print head serves to discharge selected portions of the uniformly charged photoconductive belt as it moves past the optical print head. The latent image thus formed is developed by the deposition of the toner from the developer unit 116. Illustratively, the toner is deposited only on the discharged portions of the photoconductive belt. The belt then enters the transfer region wherein the developed image is transferred to the underside of the paper. In the transfer region 125, the transfer unit 119 serves to form an electric field which attracts toner from the photoconductive belt to the undersid of the paper.

As the belt continues to rotate following image transfer, it immediately enters into the region of cleaning device 10. The residual particles are removed from the belt as described hereinabove and the belt is uniformly discharged by erase lamps 114. The belt is thereby readied for the next copy.

The cleaning device of the present invention is successful in removing the residual developer particles from the photoconductive belt without suffering from the problems of prior art cleaning devices.

While the invention has been described by reference to specific embodiments, this was for purposes of illustration only and should not be construed to limit the spirit or the scope of the invention.

We claim:

1. A cleaning device for removing residual particles from a photoconductive member in an electrographic printing apparatus, comprising brush means for being held in contact with a charged rotatable photoconductive member, said brush means being maintained at a first biasing voltage for attracting residual particles from said photoconductive member, transferring means in juxtaposition with said brush means, said transferring means being maintained at a second biasing voltage for attracting said residual particles from said brush means, said second biasing voltage being of the same polarity and greater in magnitude than said first biasing voltage, removal means for removing said residual particles from said transferring means, and discharge means for discharging said photoconductive member, said discharge means being located downstream of said brush means relative to said photoconductive member.

2. The cleaning device of claim 1, wherein said brush means comprises a fur brush.

3. The cleaning device of claim 1 wherein said transferring means comprises a metal roller.

4. The cleaning device of claim 1, wherein said removal means comprises a scraper blade.

5. The cleaning device of claim 1 wherein said first biasing voltage is about +50 V and said second biasing voltage is about +150 V.

6. The cleaning device of claim 1 further comprising conveying means associated with said removal means for conveying said residual particles away from said removal means.

7. The cleaning device of claim 6 wherein said conveying means comprises an auger.

8. A cleaning device for removing residual particles from a photoconductive member in an electrographic printing apparatus, comprising a housing, a brush for being held in contact with a charged rotatable photoconductive member, said brush being maintained at a first biasing voltage to attract said residual particles from said photoconductive member, a metal roller in juxtaposition with said brush, said metal roller being maintained at a second biasing voltage for attracting said residual particles from said brush, said second biasing voltage being of the same polarity and greater in magnitude than said first biasing voltage, a scraper blade in juxtaposition with said metal roller for removing residual particles from said metal roller, said brush, metal roller and scraper blade being disposed inside said housing, and discharge means mounted on the outside of said housing for discharging said photoconductive member, said discharge means being located downstream of said brush relative to said photoconductive member.

9. The cleaning device of claim 8 further comprising an auger associated with said scraper blade for conveying away residual particles removed by said scraper blade, said auger being disposed inside said housing.

10. The cleaning device of claim 9 wherein said first biasing voltage is about +50 V and said second biasing voltage is about +150 V.

11. A method for removing residual particles from a photoconductive member in an electrographic printing means, comprising brushing a charged photoconductive member with a brushing means while applying a first biasing voltage to said brushing means to attract residual particles from said photoconductive member, transferring said residual particles from said brushing means with a transferring means while applying a second biasing voltage to said transferring means to attract said residual particles from said brushing means, said second biasing voltage being of the same polarity and greater in magnitude than said first biasing voltage, removing said residual particles from said transferring means, and thereafter discharging said photoconductive member.

12. The cleaning device of claim 1 wherein said second biasing voltage is about 100V greater in absolute magnitude than said first biasing voltage.

13. The cleaning device of claim 1 further comprising a housing, said brush means, transferring means, and removal means being disposed within said housing, said discharge means being mounted on the outside of said housing.

14. The cleaning device of claim 11 wherein said discharge means comprises an erase lamp.

15. The cleaning device of claim 8 wherein said second biasing voltage is about 100V greater in absolute magnitude than said first biasing voltage.

16. The cleaning device of claim 8 wherein said discharge means comprises an erase lamp.

* * * * *